United States Patent [19]

Clemens

[11] 4,376,489

[45] Mar. 15, 1983

[54] CONTAINER FOR HAZARDOUS MATERIAL

[75] Inventor: Richard E. Clemens, Medford, Mass.

[73] Assignee: Bethlehem Steel Corporation, Bethlehem, Pa.

[21] Appl. No.: 237,029

[22] Filed: Feb. 23, 1981

[51] Int. Cl.[3] ..... B65D 88/74; F17C 1/12

[52] U.S. Cl. ..... 220/1.5; 62/45; 137/264; 165/136; 220/85 B; 220/435; 220/900

[58] Field of Search ..... 220/85 B, 435, 437, 220/438, 426, 446, 1.5, 902, 900; 165/136; 62/45; 206/521, 586, 591, 594; 92/98 R, 98 D; 105/358, 360; 141/18, 82, 231, 232; 137/264, 375, 593; 138/30

[56] References Cited

U.S. PATENT DOCUMENTS

| | | | |
|---|---|---|---|
| 1,196,320 | 8/1916 | Weber | 206/594 X |
| 1,606,846 | 11/1926 | Smith . | |
| 1,749,222 | 3/1930 | Merriam . | |
| 1,911,094 | 5/1933 | Skoglund | 220/85 B |
| 2,545,686 | 3/1951 | Collins | 220/435 |
| 2,551,217 | 5/1951 | Martin . | |
| 2,722,336 | 11/1955 | Wexler et al. | 220/446 X |
| 2,764,950 | 10/1956 | Finnell | 105/369 |
| 3,112,845 | 12/1963 | Bryant | 220/85 B X |
| 3,158,459 | 11/1964 | Guilhem | 220/426 X |
| 3,275,418 | 9/1966 | Nee | 220/85 B X |
| 3,612,344 | 10/1971 | Stuart | 220/85 B |
| 3,756,367 | 9/1973 | Mitchell et al. | 220/85 B X |
| 3,780,900 | 12/1973 | Yamamoto | 220/900 X |
| 3,802,464 | 4/1974 | Frank et al. | 220/85 B X |
| 3,913,775 | 10/1975 | Ozaki | 220/437 X |
| 3,930,375 | 1/1976 | Hofmann | 62/45 |
| 3,931,907 | 1/1976 | Henle | 220/85 B X |
| 4,100,868 | 7/1978 | Gablin et al. | 109/83 |
| 4,172,573 | 10/1979 | Moore et al. | 220/900 X |
| 4,231,481 | 11/1980 | Nash et al. | 220/85 B X |

FOREIGN PATENT DOCUMENTS

| | | | |
|---|---|---|---|
| 297558 | 6/1932 | Fed. Rep. of Germany | 220/900 |
| 2856442 | 7/1980 | Fed. Rep. of Germany | 220/902 |
| 126087 | 5/1919 | United Kingdom | 220/900 |

*Primary Examiner*—William Price
*Assistant Examiner*—Gary E. Elkins
*Attorney, Agent, or Firm*—Joseph J. O'Keefe; Michael J. Delaney

[57] ABSTRACT

A container for hazardous material has an outer shell, an inner cylindrical tank for hazardous material, resilient filler material between the shell and the tank, flexible, impervious diaphragms fixed within the tank and extending transversely to the longitudinal axis of the tank to provide chambers adjacent each end of the tank, and an arrangement to pressurize and de-pressurize the chambers. The flexible, impervious diaphragms act as an energy absorbent in case the container is subjected to a sudden load and in addition the diaphragms allow for thermal expansion or contraction of the hazardous material in the tank.

7 Claims, 9 Drawing Figures

CONTAINER FOR HAZARDOUS MATERIAL

BACKGROUND OF THE INVENTION

There is a need for a shock-resistant container to store and transport hazardous material. Such a container should possess sufficient structural integrity to withstand collisions, be readily adaptable to all kinds of hazardous material, allow for easy handling of the container by present cargo handling apparatus, include means to monitor the temperature and pressure of the hazardous material, be capable of meeting present day codes relating to storage and transportation of hazardous material, have a positive buoyancy so that the container floats in case it is lost at sea, and be capable of being adapted to present day tank cleaning systems. In addition, the container should be relatively inexpensive to manufacture, transport and store.

SUMMARY OF THE INVENTION

An object of this invention is to provide a shock-resistant, buoyant container for the storage and transportation of hazardous material.

Another object of this invention is to provide a container for hazardous material having substantial structural integrity such that it can withstand most collisions without loss of significant hazardous material.

Still another object of this invention is to provide a container for hazardous material adapted to include means to monitor the temperature and pressure of the hazardous material and to give a warning signal if the temperature and pressure exceeds certain limits.

A still further object of this invention is to provide a container economical to manufacture, handle and maintain.

Another object of this invention is to provide a container which is readily adaptable to safely store and handle a wide range of hazardous materials.

The above objects can be accomplished by this invention and the container disclosed herein and comprising an outer box-like, rectangular shell, an inner cylindrical tank having an intermediate tubular portion and dished end portions, fastener means extending through openings in outwardly extending flange portions on the tubular portion and on the dished end portions to secure the end portions to the tubular portion, a flexible, impervious diaphragm passing between the flange portions of the tubular portion and the end portions and secured thereto by the fastener means to provide a first chamber at one end of the tank and a second chamber at the other end of the tank, a resilient filler material occupying the space between the outside of the tank and the inside of the shell, means to supply gas pressure to and release the gas pressure from the first and second chambers, means to sense the temperature and pressure of the hazardous material in the tank and the gas pressure in the first and second chambers, means to seal the inlet and outlet openings in the tank and shell, and coil means in contact with the outside of the tank to control the temperature of the hazardous material in the tank.

DETAILED DESCRIPTION OF INVENTION

Figures 1, 2, 3, 4, 5, 6, 7, 8, 9:
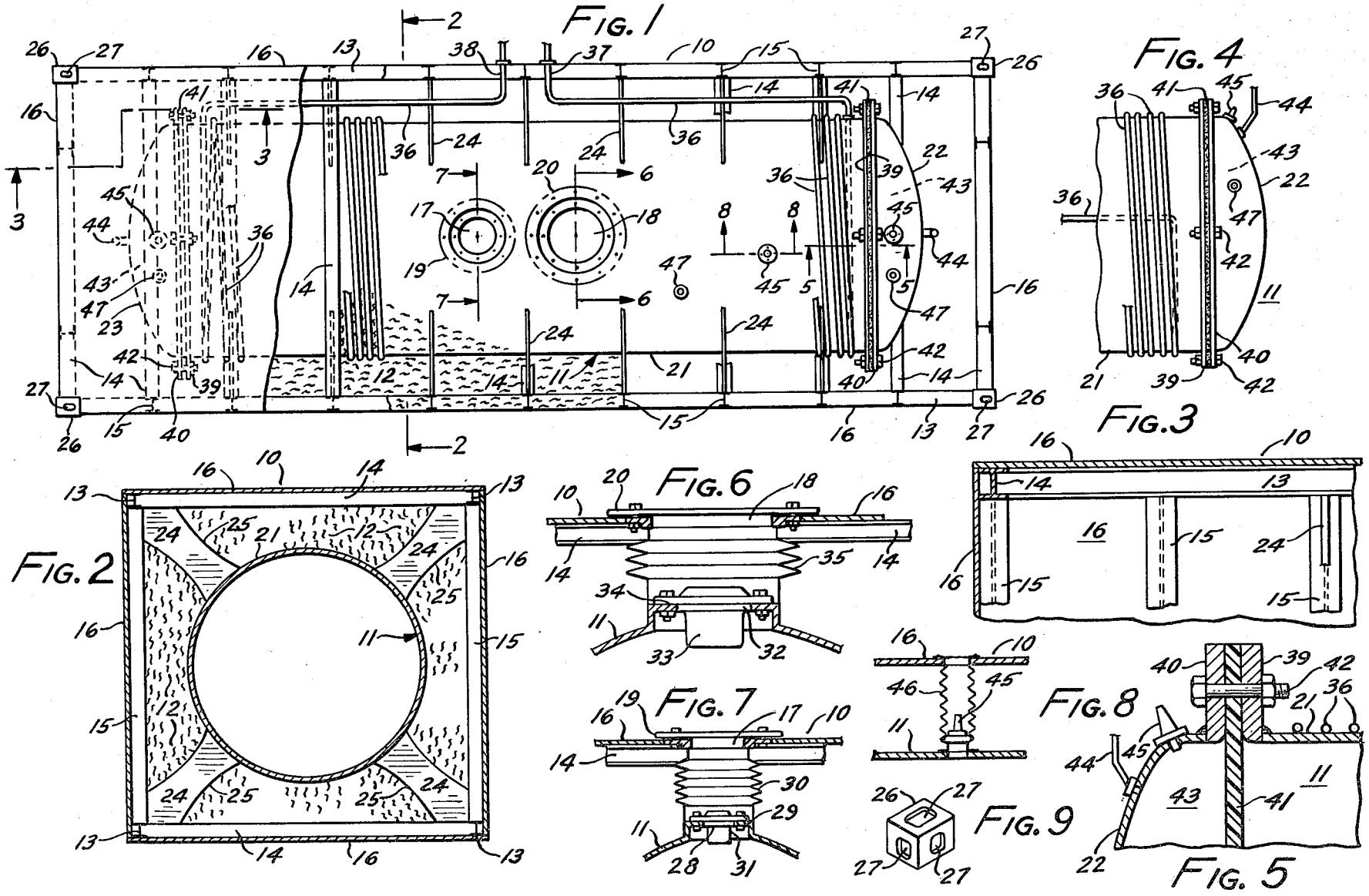
FIG. 1 is a plan view of the container of this invention with parts broken away for clarity.
FIG. 2 is a view taken along the lines 2—2 of FIG. 1.
FIG. 3 is a view taken along the lines 3—3 of FIG. 1.
FIG. 4 is a broken elevation view of one end of the inner tank.
FIG. 5 is a view taken along the lines 5—5 of FIG. 1, shown opposite hand.
FIG. 6 is a view taken along the lines 6—6 of FIG. 1.
FIG. 7 is a view taken along the lines 7—7 of FIG. 1.
FIG. 8 is a view taken along the lines 8—8 of FIG. 1.
FIG. 9 is a perspective view of a corner fitting of the container of this invention.

When used in the description of this invention the following terms are to have the following definitions. By so defining these terms equivalents thereof are also meant to be included within such definitions.

"Hazardous material" means material that exhibits the characteristic which may cause or significantly contribute to an increase in mortality or an increase in serious irreversible or incapacitating reversible illness or pose a substantial present or potential hazard to human health or the environment when it is improperly treated, stored, transported, disposed of or otherwise managed.

"Flexible, impervious diaphragm" means a member made from a material possessing sufficient elasticity to allow for thermal expansion and contraction of the hazardous material in the tank while confining the hazardous material and not allowing it to pass through the member. The material from which the flexible, impervious diaphragm is made may be a metal, plastic, rubber or other material depending upon the characteristics of the hazardous material which will be in contact with the diaphragm.

"Shock-resistant" means that the container possesses sufficient structural integrity to withstand a collision at about 34.6 miles per hour (equivalent to a drop height of 40 feet) with an object of virtually infinite mass and zero flexibility relative to the container without a significant amount of hazardous material leaving the container.

Referring to FIG. 1 the container of this invention comprises an outer shell 10, an inner cylindrical tank 11, and resilient filler material 12 occupying the space between the shell 10 and tank 11. The resilient filler material may be polyurethane foam having a density of about two pounds per cubic foot.

Referring to FIGS. 1 and 3, the outer shell 10 is box-shaped having a length substantially greater than its width and a substantially square cross section. The outer shell 10 includes four longitudinally extending I-beams 13 which are located at the four longitudinally extending edges of outer shell 10. Spaced along the length of outer shell 10, extending perpendicular to I-beams 13, and connected thereto are a series of horizontally extending I-beams 14 and vertically extending I-beams 15. I-beams 13, 14 and 15 form a rigid cage structure of great strength. Enclosing the cage structure are outer plates 16. Thus I-beams 13, 14 and 15 and outer plates 16 form the rigid outer shell 10. The shell 10 is provided with a top inlet opening 17 and an outlet opening 18. Sealing means 19 is removably attached to outer shell 10 to tightly seal inlet opening 17, while sealing means 20 is removably attached to outer shell 10 to tightly seal outlet opening 18. Attached to each of the eight corners of outer shell 10 is a corner fitting 26. Corner fitting 26, as shown in FIG. 9, has openings 27 therein to facilitate the stacking and handling of the containers by conventional cargo handling apparatus.

The inner tank 11 comprises an intermediate tubular portion 21 having a longitudinally, horizontally extending axis and dished end portions 22,23. Occupying the space between the outside of the inner tank 11 and the inside of the outer shell 10 is a resilient filler material 12.

Depending on the hazardous material to be stored and transported, the inner tank 11 and all portions of the container which come in contact with the hazardous material may be coated with a lining or coating compatible with the hazardous material. Some examples of such a lining or coating are ceramic coating, epoxy phenolic, vinyl esters, epoxy, coal tar epoxy, teflon, polyamide, polysulfide rubber, synthetic rubber, tantalum, stainless steel, titanium, zirconium, columbium, molybdenum, aluminum and fiberglass.

Extending between and attached to the inside of the outer shell 10, specifically I-beams 14,15, and the outside of the inner tank 11, as shown in FIG. 2, are four plate members 24. The plate members 24 are equally spaced about the inner tank 11 and extend to the inside longitudinal corners of the outer shell 10. The plate members 24 act as links connecting and positioning the inner tank 11 relative to the outer shell 10. In the event of a collision or similar loading the plate members 24 will yield at their reduced center portions 25, absorb energy and thereby act to maintain the integrity of the inner tank 11.

Referring to FIG. 7, the inner tank 11 has an inlet opening 28 positioned directly below and spaced from inlet opening 17 of outer shell 10. The inner tank 11 has an inwardly extending flange 29 surrounding inlet opening 28. Secured to inner tank 11 and encircling inlet opening 28 is an expansion joint bellows 30 which extends upwardly from the inner tank 11 and is attached to outer shell 10. Bellows 30 allows for relative movement between the outer shell 10 and inner tank 11 due to expansion, contraction or collision forces without damage to outer shell 10 or inner tank 11. Sealing means 31 tightly seals inlet opening 28 of tank 11 and includes well known valve means (not shown) which functions to provide safe access to inlet opening 28 without risking the escape of hazardous material from inner tank 11.

Referring to FIG. 6, the inner tank 11 has an outlet opening 32 sealed by sealing means 33. Sealing means 33 includes well known valve means (not shown) which allows for safe access to the inner tank 11 through outlet opening 32. Inner tank 11 has an inwardly extending flange 34 about outlet opening 32 for attaching sealing means 33. An expansion joint bellows 35 encircles outlet opening 32 and is attached to inner tank 11. The bellows 35 extends upwardly from tank 11 and is attached to outer shell 10 about outlet opening 18. Bellows 35 in addition to acting as a barrier to filler material 12 also allows relative movement between tank 11 and shell 10 as described above with respect to bellows 30.

Referring to FIGS. 1 and 4, means is provided to control the temperature of the hazardous material in tank 11. Such means comprises heating or cooling coil 36. One end 37 of coil 36 is attached to outer shell at about the longitudinal midpoint of the container. The end 37 is provided with a coupling for attachment to a supply of heating or cooling medium (not shown). From the longitudinal midpoint the coil 36 extends to the right hand end of the inner tank 11 as shown in FIG. 1. The coil 36 is then closely wrapped around the inner tank 11 for substantially the entire length of tubular portion 21 of the tank 11. The coil 36 is then brought back to about the longitudinal midpoint of the container and the other end 38 of coil 36 is attached to outer shell 10 at a position adjacent to end 37 of coil 36. End 38 is also provided with a coupling for attachment to a heating or cooling device.

To insure efficient conduction of the heating or cooling medium to the inner tank 11 the coil 36 may be brazed to the inner tank 11 at regular intervals. After the coil 36 is installed and brazed to the inner tank 11, insulating tape (not shown) may be wrapped around the inner tank 11 to further improve the transfer of heat between the coil 36 and tank 11 and in addition prevent the filler material 12 from adversely influencing such transfer.

Referring to FIGS. 1 and 5, tubular portion 21 of tank 11 includes outwardly extending flanges 39 at each end thereof. Each dished end portion 22,23 also includes an outwardly extending flange 40. Positioned at each end of the tubular portion 21 and held between flanges 39 of tubular portion 21 and flange 40 of dished end portions 22,23 is a flexible, impervious diaphragm 41. Thus diaphragms 41 form along with their immediately adjacent end portion 22,23 a chamber 43 at each end of inner tank 11. The flexible impervious, diaphragm 41 acts to allow for expansion and contraction of the hazardous material and also acts in conjunction with its adjacent chamber 43 to cushion any sudden surges of the hazardous material within the inner tank 11. Such sudden surges could be caused by ordinary handling of the container or a collision. Fastener means 42 passes through openings in flanges 39,40 and diaphragm 41 and secures the flanges 39,40 and diaphragms 41 to each other.

In addition to acting in conjunction with its adjacent diaphragm 41 to form a cushion chamber 43, dished end portions may be removed to allow access to the interior of inner tank 11 for cleaning and maintenance thereof.

Referring to FIGS. 1 and 4, each chamber 43 is provided with an inlet line 44 which extends through outer shell 10 and its respective dished end portions 22,23 and allows a pressurized inert gas to enter the chamber 43, by connecting the line 44 with a source of pressurized gas (not shown). A check valve (not shown) is positioned in the line 44 adjacent the dished end portion 22,23 to maintain gas pressure in the chamber 43.

As shown in FIGS. 1, 4 and 8, the inner tank 11 is provided with three safety valves 45, one valve is located in tubular portion 21, one in end portion 22 and one in end portion 23. The valves 45 are secured to the inner tank 11 and are encircled by a bellows 46 which extends between and is attached to outer shell 10 and inner tank 11. Thus valves 45 allows for excess pressure to be relieved from the tubular portion 21 and chambers 43.

Referring to FIGS. 1 and 4, the inner tank 11 may be provided with three recesses 47 for receiving temperature and/or pressure gauges (not shown) to monitor the temperature and pressure of the hazardous material in tank 11 and the gas in chambers 43. One such recess 47 is located in tubular portion 21 of tank 11, one in dished end portion 22 and one in dished end portion 23. The temperature and/or pressure gauges are electrically connected in a manner well known in the art to an indicator means and/or a warning device remote from the container. Thus should the temperature and/or pressure of the hazardous material in tank 11 or the gas pressure in either chamber 43 depart from a designated range, the indicator means would indicate such departure and render a warning signal.

SPECIFIC EXAMPLE

The following is a specific example of a container made in accordance with this invention.

| | |
|---|---|
| Length of outer shell 10 | = 20 feet |
| Cross section of outer shell 10 | = 8 feet square |
| Thickness of plates 16 | = ⅜ inch |
| Thickness of material used to make inner tank 11 | = ½ inch |
| Diameter of inner tank 11 | = 5 feet |
| Resilient filler material-polyurethane foam having a density of two pounds per cubic foot | |
| Diaphragm material-rubber | |
| Weight of container fully loaded with hazardous material | = 67,200 pounds |
| Buoyancy force when immersed in sea water | = 81,900 pounds |
| Material for outer shell 10 and inner tank 11 | - steel |
| Inert gas pressure in chambers 43 | = ½ head pressure of the hazardous material in inner tank 11 |

A one-fifth scale model of a container described above under this specific example was made. The container was filled with a liquid having a specific gravity equal to 2.0. The chambers 43 were pressurized with nitrogen to a pressure of 1 pound per square inch gauge. The model was equipped with acceleration transducers and recording devices.

The model was dropped from a height of 28 feet to reproduce a drop height of 40 feet for a full size container. Two high speed cameras were set up to film the drop of the scale model container.

After the drop, the scale model container was examined. The outer shell 10 retained its original shape and had no buckles or wrinkles. While one dished end portion was deformed, a hydrostatic test load of 150 pounds per square inch gage (psig) produced only a very slight leak at one of the flanges. The only outward sign of severe damage to the container was a fracture of the copper tubing of line 44. The resilient filler material 12 showed some compression to about two-thirds of its original thickness.

It can be seen from the above that the one-fifth scale model performed satisfactorily at a drop height of 28 feet which is equivalent to a drop height of 40 feet for a full scale container. Thus, the container met the definition of a shock-resistant container set forth above.

In addition to the above scale model drop test, a ballistics test was conducted on a container which simulated the outer shell 10, inner tank 11 and resilient filler material 12 of the above specific example. The simulated container had a box-shaped outer portion made of plate ⅜ inch thick and a box-shaped inner portion made of ½ inch thick plate as opposed to a cylindrical shape. The box shape is a more severe test than a cylindrical shape since both the ⅜ inch and the ½ inch plate extended perpendicular to the line of fire of the shell. The ⅜ and ½ inch plates were made from ABS Grade A steel. Between the ⅜ inch and ½ inch plate was 18 inches of polyurethane foam.

From a distance of twenty feet a standard thirty caliber military shell was fired at and perpendicular to the ⅜ inch plate. The shell pierced the ⅜ inch plate and made a slight indentation of about 0.020 inches in depth and about 0.4375 inches in diameter in the ½ inch plate. The back side of the ½ inch plate showed no deformity.

A second test was performed under the same conditions except that a thirty caliber armor piercing shell was used. Upon firing the shell passed through the ⅜ inch plate and became embedded in the ½ inch plate. The nose of the shell did not extend through the ½ inch plate although the back side of the plate showed a fracture. A hydrostatic test load was applied to the area surrounding the shell, the test showed that the area sustained 150 PSIG without a leak, but a slight leak took place at about 500 PSIG.

The above ballistics test shows that the container of this invention would be resistant to significant damage by firearms.

Although I have disclosed my invention in considerable detail it should be apparent that various substitutes and modifications may be made in the kinds of materials used to construct the container of this invention, the size of the container, and the relative position of various components. Therefore, I do not wish to be limited narrowly to the exact and specific particulars disclosed herein but I may also use such substitutes, modifications and equivalents as are within the scope and spirit of the invention or pointed out in the appended claims.

I claim:

1. A container for hazardous material comprising (a) an outer shell, (b) an inner cylindrical tank to be substantially filled with hazardous material, (c) resilient filler material between the shell and the tank, (d) a first flexible, impervious diaphragm member fixed within the tank and extending in a plane substantially transverse to the longitudinal axis of the tank to provide a first chamber adjacent one end of the tank free of hazardous material, and (e) means to pressurize the chamber by admitting a gas thereto and thereby allow for the expansion, contraction and movement of the hazardous material by flexing of the diaphragm member.

2. The container of claim 1 further comprising a second flexible, impervious diaphragm member fixed within the tank and extending in a plane substantially transverse to the longitudinal axis of the tank to provide a second chamber free of hazardous material adjacent the other end of the tank.

3. The container of claim 1 further comprises means to pressurize and to relieve the pressure from the first chamber.

4. The container of claim 2 further comprising means to pressurize and to relieve the pressure from the first and second chambers.

5. The container of claims 1, 2, 3 or 4 further comprising means to control the temperature of the hazardous material in the inner tank.

6. The containers of claims 1, 2, 3 or 4 further comprising an opening in the outer shell positioned adjacent an opening in the tank located at about the longitudinal midpoint of the tank, an expansion joint bellows extending between the openings, means to seal the opening in the shell and means to seal the opening in the tank.

7. A container for hazardous material comprising (a) an outer shell, (b) an inner cylindrical tank for hazardous material including an intermediate tubular portion to be substantially filled with hazardous material and dished end portions, (c) a resilient filler material between the shell and the tank, (d) plate members extending between and fixed to the inside of the outer shell and the outside of the tank to position the tank within the shell, (e) outwardly extending flange portions on each end of the tubular portion and on the dished end portions, (f) a flexible, impervious diaphragm extending in a plane substantially transverse to the longitudinal axis of the tank and positioned between each flange portion of the tubular portion and its adjacent flange portion of the dished end portion to fix said diaphragm within the tank, (g) fastener means to secure each flange portion of the tubular portion to its adjacent flange of the dished end portion, (h) means to pressurize by admitting a gas to the chambers and to relieve the pressure from the chambers formed by each diaphragm and its adjacent dished end portion to allow for expansion, contraction and movement of the hazardous material by flexing of the diaphragm member, and (i) an opening in the outer shell positioned adjacent an opening in the tank located at about the longitudinal midpoint of the tank, an expansion joint bellows extending between the openings, and means to seal the openings.

* * * * *